US007044483B2

(12) United States Patent
Robertson et al.

(10) Patent No.: US 7,044,483 B2
(45) Date of Patent: May 16, 2006

(54) STACKING COOLER

(75) Inventors: James David Robertson, Atlanta, GA (US); Jason Walesh, Dallas, GA (US)

(73) Assignee: Display Industries, LLC., Nocross, GA (US)

( * ) Notice: Subject to any disclaimer, the term of this patent is extended or adjusted under 35 U.S.C. 154(b) by 203 days.

(21) Appl. No.: 10/776,051

(22) Filed: Feb. 11, 2004

(65) Prior Publication Data

US 2005/0173431 A1 Aug. 11, 2005

(51) Int. Cl.
*B62B 3/16* (2006.01)

(52) U.S. Cl. ..... 280/33.998; 206/505; 206/509; 220/4.27

(58) Field of Classification Search ..... 280/79.3, 280/33.998; 206/545, 541, 544, 549, 503, 206/505, 515, 518, 519, 520; 220/4.27, 23.6, 220/23.83, 592.1, 592.15, 23.87
See application file for complete search history.

(56) References Cited

U.S. PATENT DOCUMENTS 3,811,559 A * 5/1974 Carter ..... 206/545
3,933,296 A * 1/1976 Ruskin et al. ..... 229/406
4,648,512 A * 3/1987 Tarozzi et al. ..... 206/542
4,728,504 A * 3/1988 Nichols ..... 422/297
5,409,126 A * 4/1995 DeMars ..... 220/4.27
5,423,426 A * 6/1995 Harper ..... 206/545
5,465,988 A * 11/1995 Dennis ..... 280/47.35
5,671,611 A * 9/1997 Quigley ..... 62/457.7
5,709,307 A * 1/1998 Rosado et al. ..... 206/548
5,730,311 A * 3/1998 Curtis ..... 220/371
5,996,366 A * 12/1999 Renard ..... 62/256
6,026,978 A * 2/2000 Clegg et al. ..... 220/592.1
6,085,930 A * 7/2000 Curtis ..... 220/371
6,105,980 A * 8/2000 Cino et al. ..... 280/33.998
6,431,580 B1 * 8/2002 Kady ..... 280/655
6,626,006 B1 * 9/2003 Tedder ..... 62/457.7
6,651,456 B1 * 11/2003 White et al. ..... 62/457.7
6,763,959 B1 * 7/2004 Tedder ..... 211/188
6,915,657 B1 * 7/2005 Wood ..... 62/371

* cited by examiner

*Primary Examiner*—J. Allen Shriver
(74) *Attorney, Agent, or Firm*—John L. James

(57) ABSTRACT

A cooler is composed of a number of stackable units. Each unit has inner and outer shells with an air space between them. The outer shell has bottom, side and end panels connected together forming an outer tub with a drain. An inner shell has bottom, side and end panels connected together forming an inner tub. Drain openings in the inner tub allow water to flow to the drain in the outer tub. The bottom panel of the inner shell is spaced from the bottom panel of the outer shell creating an air space therebetween. The bottom of one unit can nest in the top of another unit to stack the units one atop the other. Wheels are attached to the bottommost unit.

19 Claims, 8 Drawing Sheets

STACKING COOLER

TECHNICAL FIELD OF THE INVENTION

This invention pertains to a cooler for chilling and displaying beverages and other merchandise.

BACKGROUND OF THE INVENTION

Movable or portable ice-filled coolers are useful in a retail environment for chilling beverages and other items while putting them within easy reach of a consumer. A problem with coolers is that that sometimes a consumer has to dig around in the ice to find the desired product from among several different product brands. Even when a cooler contains only one product brand, that product may be completely covered by the ice and out of view requiring the consumer to dig around in the ice to find it. Accordingly, it will be appreciated that it would be highly desirable to have cooler that chills products while keeping the products visible and accessible. It is also desirable to have a cooler that can be easily moved about.

In convenience stores, chilled beverages may be impulse purchase items that must be placed in or along the pathway of the consumer. Such locations are the end of aisle, open space near the check-out, and in the aisle itself. Waist high cylindrical coolers are often used in such locations but cannot be seen from all directions because store shelving obscures the view. It is desirable to have a cooler that places product at eye level and positions the beverage containers so that they are visible from several directions.

SUMMARY OF THE INVENTION

The present invention is directed to overcoming one or more of the problems set forth above. Briefly summarized, according to one aspect of the present invention, a cooler has a plurality of units that stack atop one another. Each stackable unit comprises inner and outer shells. The outer shell has a bottom panel, opposed side panels connected to both the bottom panel and opposed end panels connected to the bottom and side panels. One of the side panels defines a drain. The inner shell has a bottom panel, opposed side panels connected to the bottom panel and opposed end panels connected to the bottom and side panels. One of the side and bottom panels defines a drain opening. The bottom panel of the inner shell is spaced from the bottom panel of the outer shell creating an insulating air space therebetween.

To facilitate stacking, a pair of opposed ledges are formed in opposed top portions of the inner and outer end panels, and a pair of opposed legs extend downward from the bottom panel of the outer shell adjacent the opposed end panels of the outer shell. The legs rest on the ledge for stacking. Stacking the units one atop the other allows the drain of an upper unit to dispense water to a lower unit for easier removal of spent liquid. In another embodiment, stacking is accomplished using openings in one unit that mate with protrusions in another unit.

The cooler can be equipped with a base member that has a sidewall with an internal ledge thereon for receiving a stackable unit. The sidewall also has upper and lower portions with the upper portion overhanging the lower portion. Wheels are supported on a bottom wall making the cooler mobile for easy positioning on the merchandise floor.

According to another aspect of the present invention, a cooler comprises a bottom tub having a bottom panel, opposed front and rear tub panels attached to the bottom panel and opposed left and right end panels attached to the bottom panel and to the front and rear tub panels. The left and right end panels extend upward from the bottom panel to an elevation above the front and rear panels. The left and right end panels each have opposed side edges extending upward and outward away from the front and rear tub panels. The left and right end panels extend the tub upward above the front and rear tub panels.

A front connecting panel is attached to a front edge of the left end panel and a front edge of the right end panel. A front bridging panel has end portions attached to the left and right end panels and has side edges attached to the front connecting panel and the front tub panel. A rear connecting panel is attached to a rear edge of the left end panel and a rear edge of the right end panel. A rear bridging panel has end portions attached to the left and right end panels and has side edges attached to the rear connecting panel and the rear tub panel.

The cooler also has a top tub that is identical to the bottom tub and is attached to the bottom tub. A drain is positioned to drain the top tub into the bottom tub so that water from melting ice cascades from an upper tub down into a lower tub.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
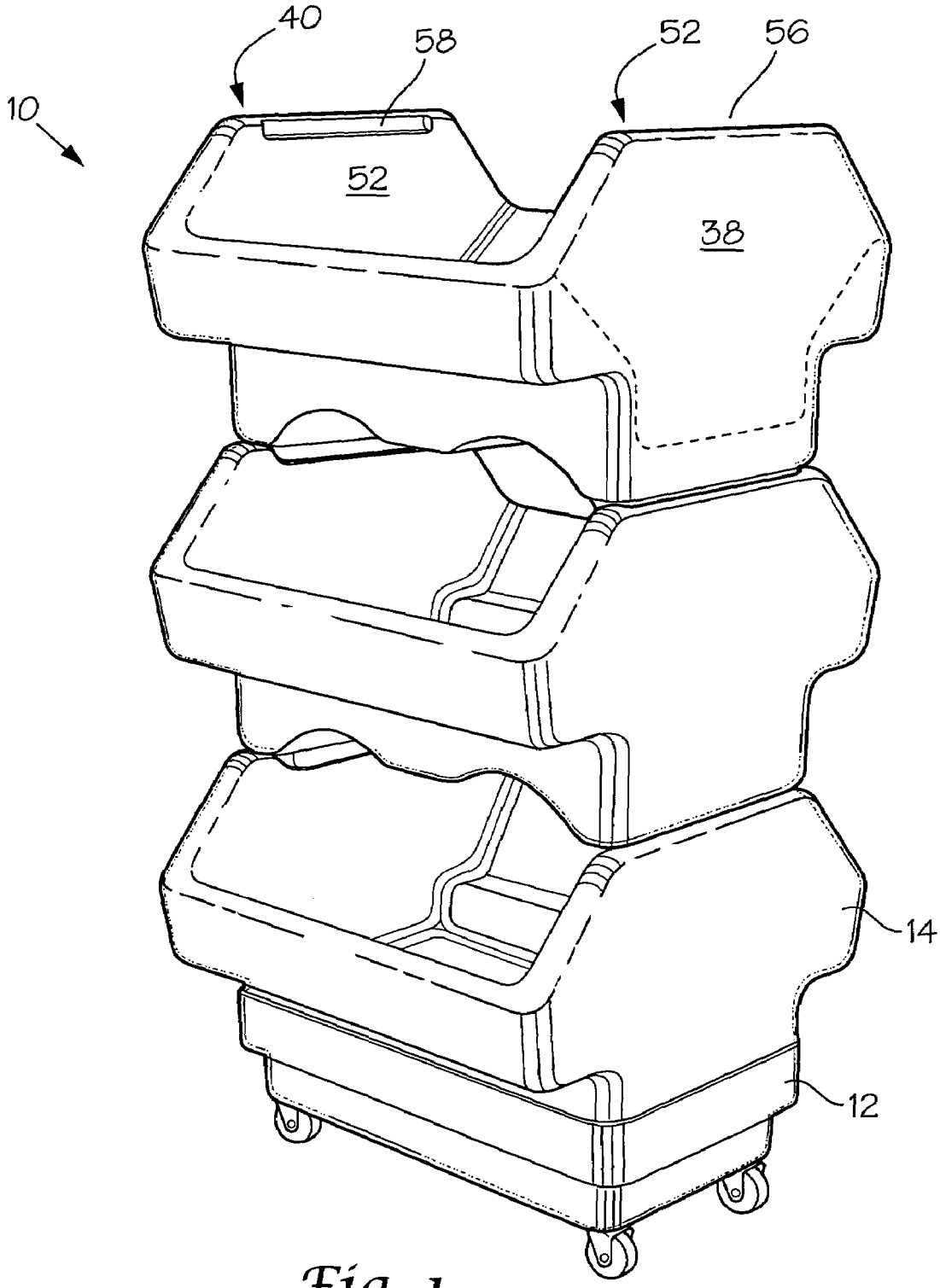
FIG. 1 is a front perspective view of a preferred embodiment of a cooler with three stackable units and a base unit with wheels according to the present invention.
Figure 2:
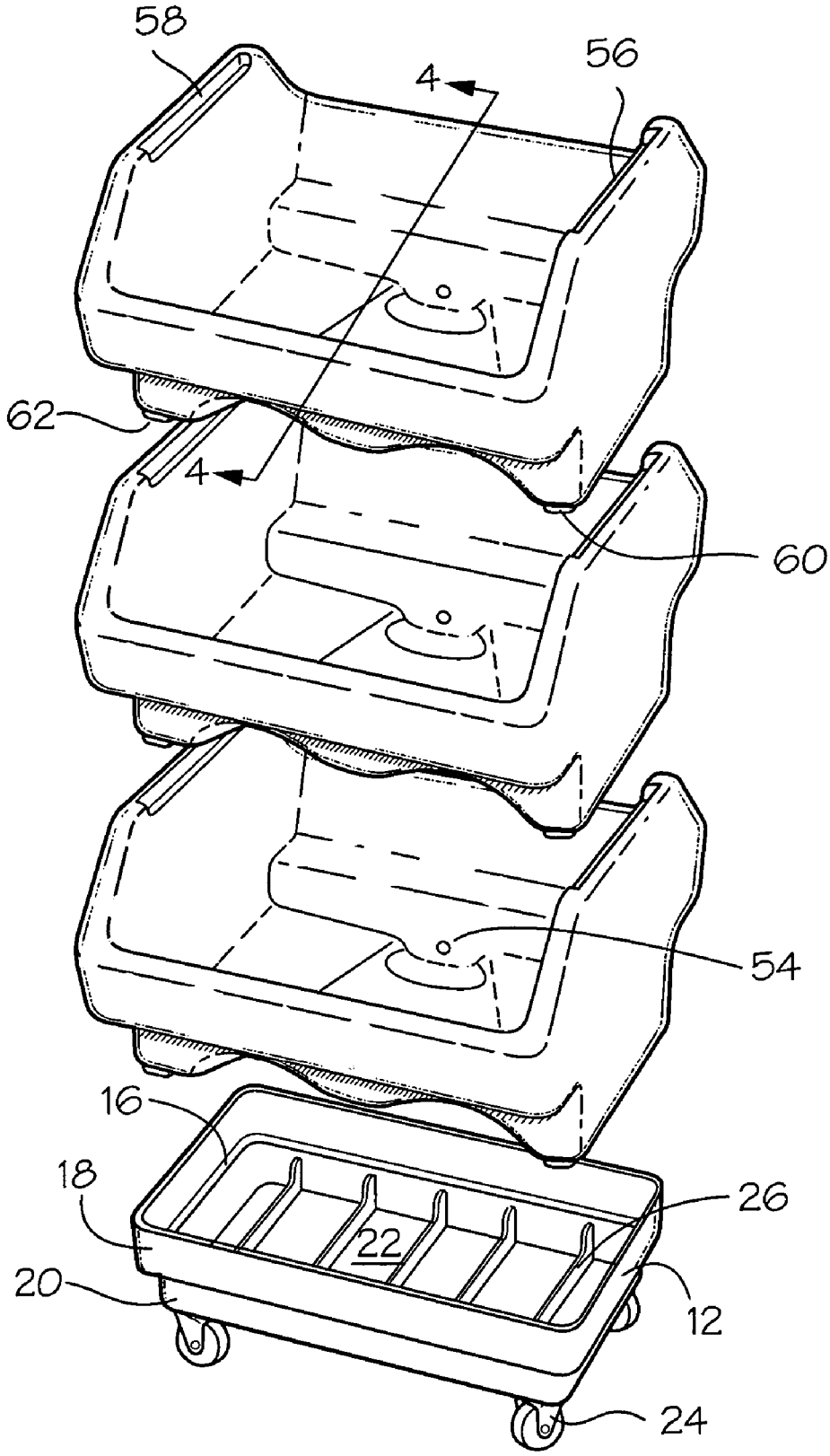
FIG. 2 is an exploded front perspective view of the stackable units of FIG. 1.
Figure 3:
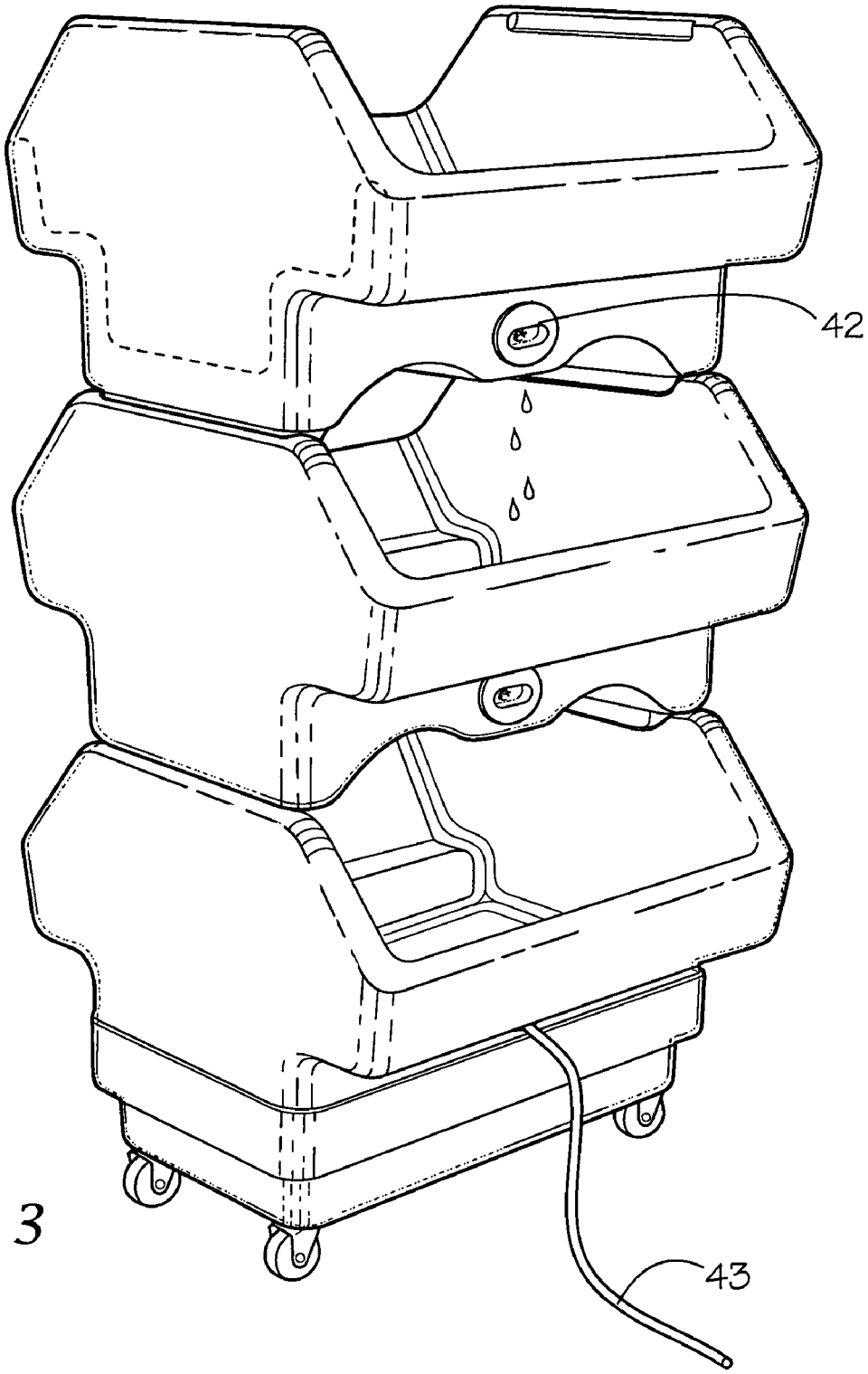
FIG. 3 is a rear view of the cooler of FIG. 1.
Figure 4:
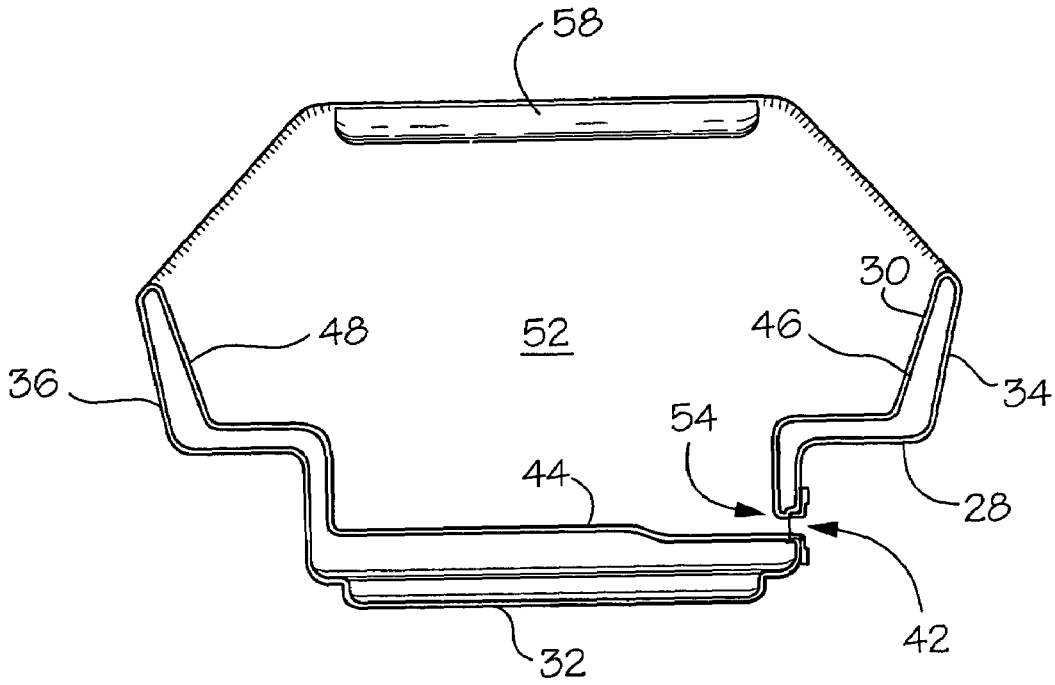
FIG. 4 is a diagrammatic cross-sectional view of one cooler unit taken along line 4—4 of FIG. 2.

Referring to FIGS. 1–4, a cooler 10 is comprised of a base unit 12 and a number of stackable units 14 that stack atop one another. Base unit 12 has a sidewall with an internal ledge 16 thereon for receiving the one of the stackable units 14. The sidewall has upper and lower portions 18, 20 with the upper portion 18 overhanging the lower portion 20. A bottom wall 22 is attached to lower sidewall portion 20. Bottom wall 22 may have lateral or transverse reinforcing ribs 26. Wheel means 24, such as actual wheels, coasters or rollers, are attached to the bottom wall.

Each stackable unit 14 has an outer shell 28 and an inner shell 30. Outer shell 28 has a bottom panel 32, opposed side panels 34, 36 connected to bottom panel 32 and opposed end panels 38, 40 connected to the bottom and side panels. Side panel 36 defines a drain 42. A tube or drain hose 43 may extend from the drain opening of the bottommost stackable unit instead of a spigot.

Inner shell 30 has a bottom panel 44, opposed side panels 46, 48 connected to bottom panel 44 and opposed end panels 50, 52 connected to the bottom and side panels. One of the side and bottom panels define a drain opening or openings 54. The bottom panel 44 of the inner shell 30 is spaced from the bottom panel 32 of the outer shell 28 creating an insulating air space therebetween. The inner shell 30 is preferably spaced from the outer shell 28 by an insulating air space. The air space between the bottom panels 32, 44 can vary from one stackable unit to the next to accommodate containers of different volumes and dimensions.

Top portions of inner shell 30 and outer shell 28 are joined together along their top edges or with a connecting panel forming opposed end panels of the stackable unit. A pair of opposed ledges 56, 58 are formed in the opposed end panels to facilitate stacking. A pair of opposed legs 60, 62 extend downward from the bottom panel 44 of outer shell 28 adjacent opposed end panels 50, 52 of outer shell 28. The ledges 56, 58 and legs 60, 62 form a means for stacking one unit with another.

The end panels 50, 52 of outer shell 28 each have bottom, middle and top portions. The bottom portion preferably has a rectangular configuration. The middle portion extends upward from the bottom portion and has a greater width than the bottom portion. The top portion has an isosceles trapezoid configuration with the base or long parallel side of the trapezoid adjoining the middle portion.

Similarly, the end panels 38, 40 of inner shell 30 each have bottom, middle and top portions. The bottom portion preferably has a rectangular configuration. The middle portion extends upward from the bottom portion and has a greater width than the bottom portion. The top portion has an isosceles trapezoid configuration with the base or long parallel side of the trapezoid adjoining the middle portion. The end panels 50, 52 of outer shell 28 may be of the same dimensions as the end panels 38, 40 of inner shell 30 but do not necessarily have to be the same.

Each unit includes a pair of opposed internal ledges 64, 66 with each ledge located at the junction of the base panel 32, and one of the inner side panels 46, 48. Top portions of each of the opposed side panels 46, 48 preferably have an elevation less than the elevation of the base of the isosceles trapezoid of the top portions of the end panels.

Figure 5:
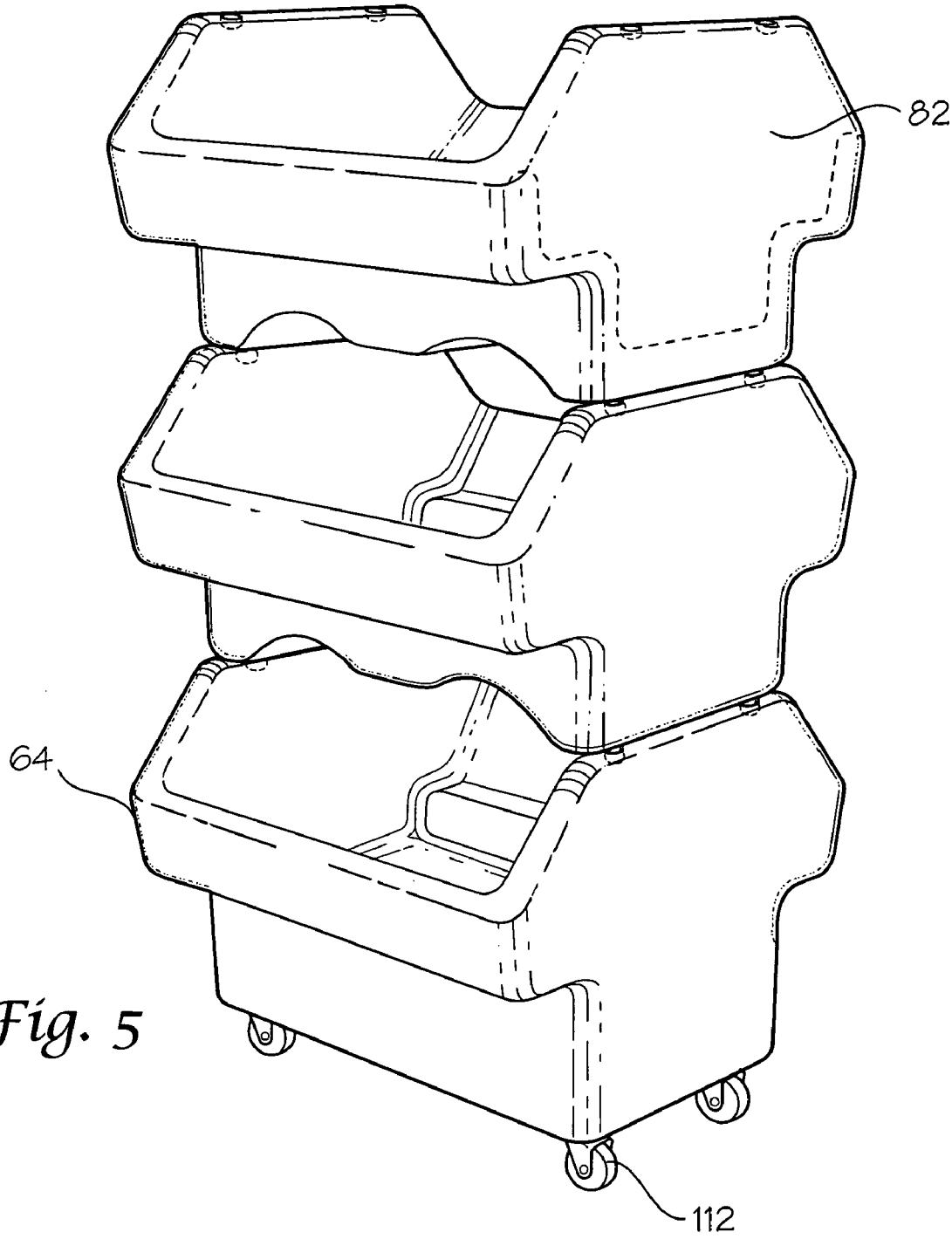
FIG. 5 is a front perspective view of another preferred embodiment of a cooler with three stackable units and a base unit with wheels according to the present invention.
Figure 6:
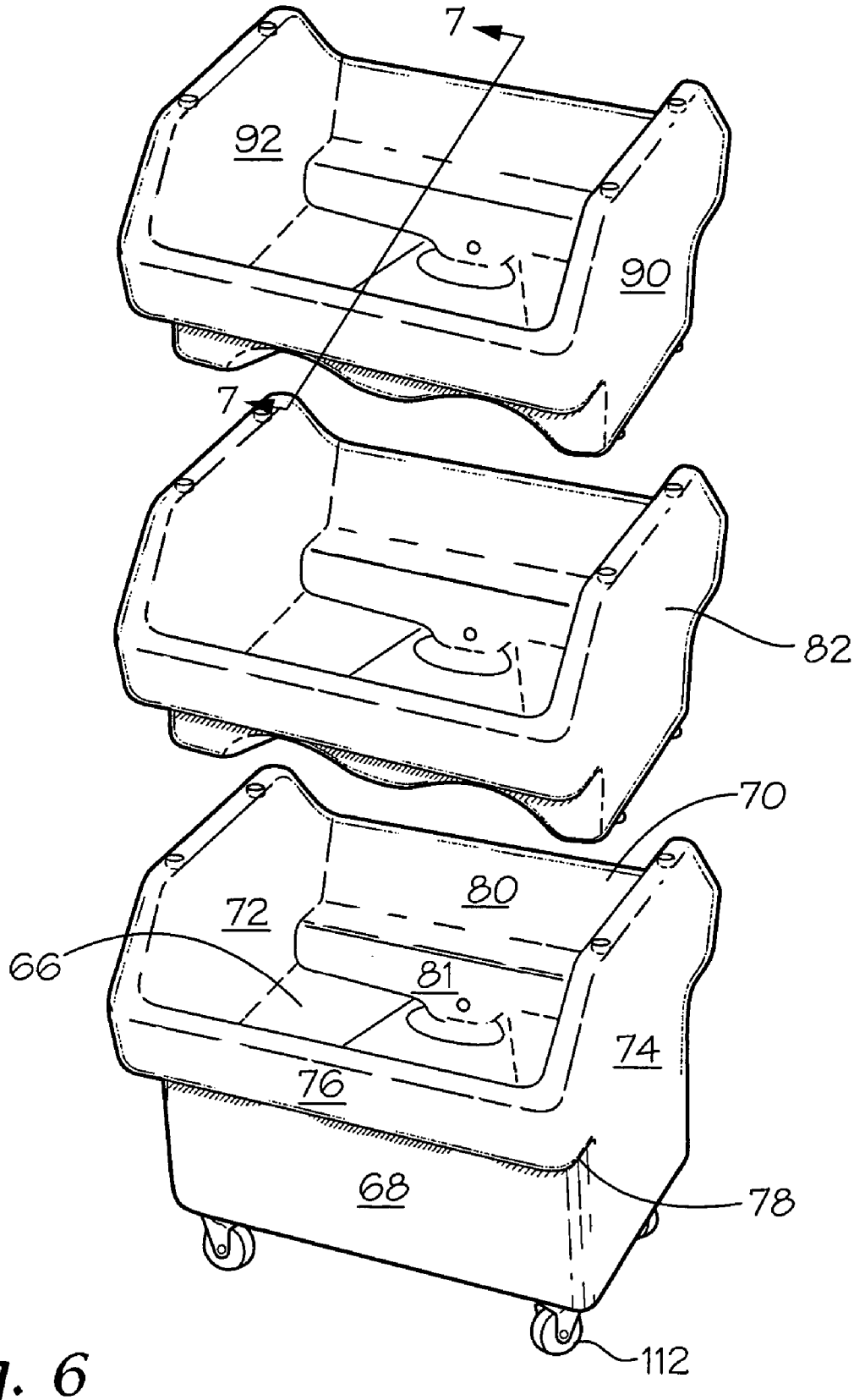
FIG. 6 is an exploded front perspective view of stackable units of similar to FIG. 1 but illustrating another preferred embodiment.
Figure 7:
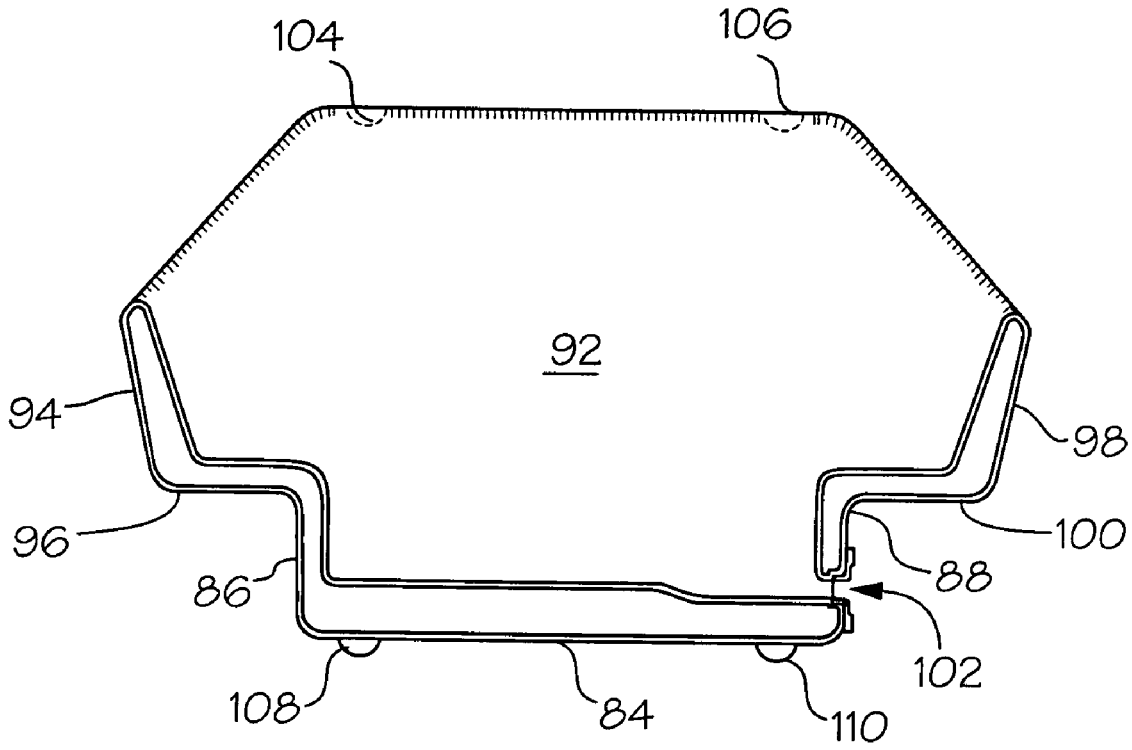
FIG. 7 is a diagrammatic cross-sectional view of one cooler unit taken along line 7—7 of FIG. 6.

Referring to FIGS. 5–7, a cooler has a lower tub 64 having a bottom panel 66, opposed front and rear tub panels 68, 70 attached to bottom panel 66 and opposed left and right end panels 72, 74 attached to bottom panel 66 and to the front and rear tub panels 68, 70. The left and right end panels 72, 74 extend upward from bottom panel 66 to an elevation above the topmost portions of front and rear panels 68, 70. The left and right end panels 72, 74 each have opposed side edges extending upward and outward away from front and rear tub panels 68, 70. Left and right end panels 72, 74 extend tub 64 upward above front and rear tub panels 68, 70.

A front connecting panel 76 is attached to a front edge of left end panel 72 and a front edge of right end panel 74. A front bridging panel 78 has end portions attached to left and right end panels 72, 74 and has side edges attached to front connecting panel 76 and front tub panel 68. Similarly, a rear connecting panel 80 is attached to a rear edge of left end panel 72 and a rear edge of right end panel 74. A rear bridging panel 80 has its end portions attached to left and right end panels 72, 74 and has its side edges attached to rear connecting panel 80 and rear tub panel 70.

An upper tub 82 has a bottom panel 84, opposed front and rear tub panels 86, 88 attached to bottom panel 84 and opposed left and right end panels 90, 92 attached to bottom panel 84 and to front and rear tub panels 86, 88. Left and right end panels 90, 92 extend upward from bottom panel 84 to an elevation above the topmost portions of front and rear panels 86, 88. Left and right end panels 90, 92 each have opposed side edges extending upward and outward away from front and rear tub panels 86, 88. Left and right end panels 90, 92 extend tub 82 upward above front and rear tub panels 86, 88.

A front connecting panel 94 is attached to a front edge of left end panel 90 and a front edge of right end panel 92. A front bridging panel 96 has end portions attached to left and right end panels 90, 92 and has side edges attached to front connecting panel 94 and front tub panel 86. A rear connecting panel 98 is attached to a rear edge of left end panel 90 and a rear edge of right end panel 92. A rear bridging panel 100 has its end portions attached to left and right end panels 90, 92 and has its side edges attached to rear connecting panel 98 and rear tub panel 88.

A drain 102 is positioned to carry water from melting ice in upper tub 82 to lower tub 64, to a drain of a plumbing system or other location for recycling or disposal. In its simplest form drain 102 may be an opening through which water flows or drips out of the upper tub into the lower tub. The drain may incorporate a tube or hose for delivering water from one tub to another. When the drain is located in an end panel or bottom panel, a tube or hose is inconspicuous. In some instances where several units are stacked one atop the other, it may be desirable to use the bottom tub solely for collecting water. This is particularly useful where there is no building drain nearby and running a hose is not possible or practicable. Using the bottommost tub in such a manner is acceptable where the object is to have the product at eye level. When product is placed in the lowermost tub, it can be chilled from the water cascading from the upper tubs.

The left and right end panels 90, 92 have top edges with openings 104, 106 formed therein and bottom edges with protrusions 108, 110 extending downward therefrom. Protrusions 108 is received in openings 104 while protrusions 110 are received in openings 106. The protrusions and openings thus form a means for attaching one tub atop another tub.

Wheel means 112 are attached to the bottom panel 66 of lower tub 64 so that the cooler can be easily moved about to position it at the desired location, to refill it with product or ice, or to empty accumulated water.

Figure 8:
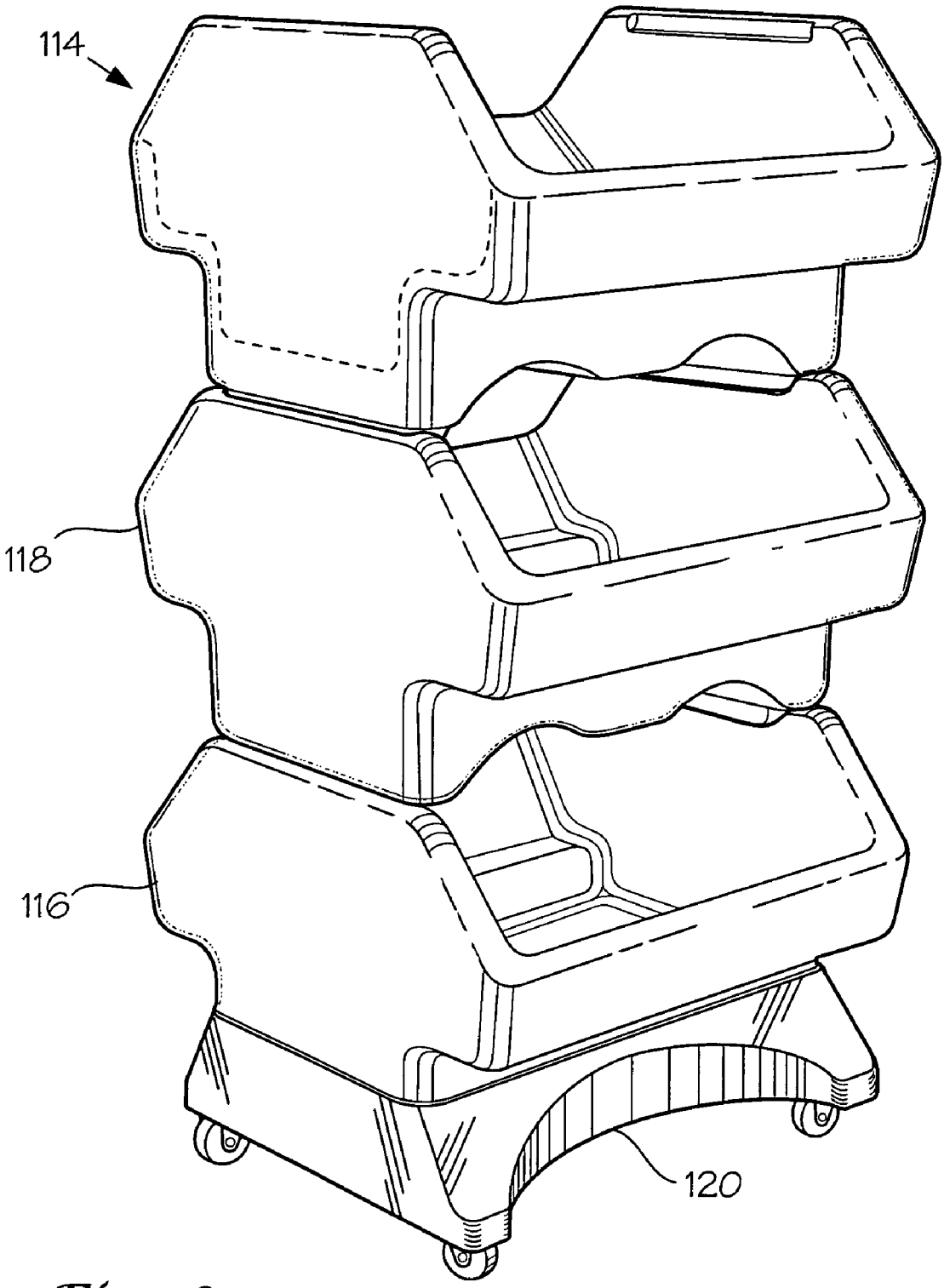
FIG. 8 is a rear perspective view of another preferred embodiment of a cooler with three stackable units and a base unit with a curved sidewall.

Referring to FIG. 8, a cooler 114 is comprised of a base unit 116 and a number of stackable units 118 that stack atop one another. Base unit 116 has a sidewall 120 that curves inward creating a space for a drain bucket. Stackable units 118 have cascading drains with the bottom most unit draining into a drain bucket positioned under it in the curved sidewall 120. The curved sidewall makes removing spent water easy when it is desired to keep the cooler fixed in position and a drain hose is not practical or desired.

It can now be appreciated that a cooler has been presented which has a plurality of units that stack atop one another. Each stackable unit comprises inner and outer shells. The outer shell has a bottom panel, opposed side panels connected to the bottom panel and opposed end panels connected to the bottom and side panels. One of the side panels defines a drain. The inner shell is similarly constructed. The bottom panel of the inner shell is spaced from the bottom panel of the outer shell creating an insulating air space therebetween.

To facilitate stacking, a pair of opposed ledges are formed in opposed top portions of the inner and outer end panels, and a pair of opposed legs extend downward from the bottom panel of the outer shell adjacent the opposed end panels of the outer shell. The legs rest on the ledge for stacking. Stacking the units one atop the other allows the drain of an upper unit to dispense water to a lower unit for easier removal.

The cooler can be equipped with a base member that has a sidewall with an internal ledge thereon for receiving a stackable unit. The sidewall also has upper and lower portions with the upper portion overhanging the lower portion. Wheels are supported on a bottom wall making the cooler mobile for easy positioning on a merchandise floor.

The panels can have curved edges for aesthetic appeal. The ledges hold the beverage containers at an angle for ease of removal and appearance. The drain may be a valve or faucet to control water flow to facilitate draining the water into a pail or other receptacle.

It can also be appreciated that another embodiment of a cooler comprises a bottom tub having a bottom panel, opposed front and rear tub panels attached to the bottom panel and opposed left and right end panels attached to the bottom panel and to the front and rear tub panels. The left and right end panels extend upward from the bottom panel to an elevation above the front and rear panels. The left and right end panels each have opposed side edges extending upward and outward away from the front and rear tub panels. The left and right end panels extend the tub upward above the front and rear tub panels.

A front connecting panel is attached to a front edge of the left end panel and a front edge of the right end panel. A front bridging panel has end portions attached to the left and right end panels and has side edges attached to the front connecting panel and the front tub panel. A rear connecting panel is attached to a rear edge of the left end panel and a rear edge of the right end panel. A rear bridging panel has end portions attached to the left and right end panels and has side edges attached to the rear connecting panel and the rear tub panel. The panels may be insulating panels that help keep the beverages cold.

The cooler also has a top tub that is identical to the bottom tub and is attached to the bottom tub. A drain is positioned to drain the top tub into the bottom tub so that water from melting ice cascades from an upper tub down into a lower tub.

While the invention has been described with particular reference to the preferred embodiments, it will be understood by those skilled in the art that various changes may be made and equivalents may be substituted for elements of the preferred embodiments without departing from invention. For example, it is contemplated that the cooler units are interchangeable but graphics can be added for product identification which would render units unique and not interchangeable after graphics are applied.

As is evident from the foregoing description, certain aspects of the invention are not limited to the particular details of the examples illustrated, and it is therefore contemplated that other modifications and applications will occur to those skilled in the art. For example, the tub may be of configurations other than the rectangular bottomed configuration described. It is accordingly intended that the claims shall cover all such modifications and applications as do not depart from the true spirit and scope of the invention.

What is claimed is:

1. A cooler having a plurality of units stackable atop one another, each said unit comprising:

an outer shell having a bottom panel, opposed side panels connected to said bottom panel and opposed end panels connected to said bottom and side panels, each of said end panels of said outer shell having a bottom portion, a middle portion extending from said bottom portion and having a greater width than said bottom portion, and a top portion having an isosceles trapezoid configuration with the base of the trapezoid adjoining said middle portion, one of said side panels defining a drain;

an inner shell having a bottom panel, opposed side panels connected to said bottom panel and opposed end panels connected to said bottom and side panels, one of said side and bottom panels defining a drain opening, said bottom panel of said inner shell being spaced from said bottom panel of said outer shell creating an air space therebetween; and means for stacking said unit with another unit.

2. A cooler, as set forth in claim 1, wherein said means for stacking includes:

a pair of opposed ledges formed in opposed top portions of said inner and outer end panels; and a pair of opposed legs extending downward from said bottom panel of said outer shell adjacent said opposed end panels of said outer shell.

3. A cooler, as set forth in claim 1, wherein said bottom portion has a rectangular configuration.

4. A cooler, as set forth in claim 1, wherein said top portion has an isosceles trapezoid configuration with a long parallel side adjoining said middle portion.

5. A cooler, as set forth in claim 1, including a base member having a sidewall with an internal ledge thereon for receiving said unit.

6. A cooler, as set forth in claim 5, wherein said sidewall has upper and lower portions with said upper portion overhanging said lower portion.

7. A cooler, as set forth in claim 6, including:

a bottom wall attached to said sidewall; and wheel means attached to said bottom wall.

8. A cooler, as set forth in claim 1, including:

a bottom unit having an inwardly curving sidewall.

9. A cooler having a plurality of units stackable atop one another, each said unit comprising:

an outer shell having a bottom panel, opposed side panels connected to said bottom panel and opposed end panels connected to said bottom and side panels, one of said side panels defining a drain, each of said end panels of said inner shell having a bottom portion, a middle portion extending from said bottom portion and having a greater width than said bottom portion, and a top portion having an isosceles trapezoid configuration with the base of the trapezoid adjoining said middle portion;

an inner shell having a bottom panel, opposed side panels connected to said bottom panel and opposed end panels connected to said bottom and side panels, one of said side and bottom panels defining a drain opening, said bottom panel of said inner shell being spaced from said bottom panel of said outer shell creating an air space therebetween; and means for stacking said unit with another unit.

10. A cooler, as set forth in claim 9, including a pair of opposed ledges with each ledge located at the junction of said base panel and one of said side panels.

11. A cooler, as set forth in claim 10, wherein top portions of each of said opposed side panels have an elevation less than the elevation of said base of said isosceles trapezoid of said top portion.

12. A cooler, as set forth in claim 9, wherein said top portion has an isosceles trapezoid configuration with a long parallel side adjoining said middle portion.

13. A cooler, comprising:

a bottom tub having a bottom panel, opposed front and rear tub panels attached to said bottom panel and opposed left and right end panels attached to said bottom panel and to said front and rear tub panels, said left and right end panels extending upward from said bottom panel to an elevation above said front and rear panels, said left and right end panels each having opposed side edges extending upward and outward away from said front and rear tub panels, said left and right end panels extending said tub upward above said front and rear tub panels;

a front connecting panel attached to a front edge of said left end panel and a front edge of said right end panel;

a front bridging panel having end portions attached to said left and right end panels and having side edges attached to said front connecting panel and said front tub panel;

a rear connecting panel attached to a rear edge of said left end panel and a rear edge of said right end panel; and a rear bridging panel having end portions attached to said left and right end panels and having side edges attached to said rear connecting panel and said rear tub panel.

14. A cooler, as set forth in claim 13, including;

a top tub having a bottom panel, opposed front and rear tub panels attached to said bottom panel and opposed left and right end panels attached to said bottom panel and to said front and rear tub panels, said left and right end panels extending upward from said bottom panel to an elevation above said front and rear panels, said left and right end panels each having opposed side edges extending upward and outward away from said front and rear tub panels, said left and right end panels extending said tub upward above said front and rear tub panels;

a front connecting panel attached to a front edge of said left and panel and a front edge of said right end panel;

a front bridging panel having end portions attached to said left and right end panels and having side edges attached to said front connecting panel and said front tub panel;

a rear connecting panel attached to a rear edge of said left and panel and a rear edge of said right end panel;

a rear bridging panel having end portions attached to said left and right end panels and having side edges attached to said rear connecting panel and said rear tub panel;

a drain positioned to empty said top tub into said bottom tub; and means for attaching said top tub atop said bottom tub.

15. A cooler having a plurality of units stacked atop one another, each said unit comprising:

a tub having a bottom panel, opposed front and rear tub panels attached to said bottom panel and opposed left and right end panels attached to said base panel and to said front and rear tub panels, said left and right end panels extending upward from said bottom panel to an elevation above said front and rear tub panels, said left and right end panels each having opposed side edges extending upward and outward away from said front and rear tub panels, said left and right end panels extending said tub upward above said front and rear tub panels;

a front connecting panel attached to said front tub panel, a front edge of said left end panel and a front edge of said right end panel; and a rear connecting panel attached to said rear tub panel, a rear edge of said left end panel and a rear edge of said right end panel, said front and rear connecting panels extending said tub upward above said front and rear tub panels.

16. A cooler, as set forth in claim 15, wherein said left and right end panels each have a top edge with openings formed therein.

17. A cooler, as set forth in claim 15, wherein said left and right end panels each have a bottom edge with protrusions formed thereon.

18. A cooler, as set forth in claim 15, including wheel means attached to said bottom panel.

19. A cooler, as set forth in claim 15, including a drain in one of said bottom, front tub, rear tub, left end and right end panels.

* * * * *